US006035860A

United States Patent [19]

Mombourquette

[11] Patent Number: 6,035,860

[45] Date of Patent: Mar. 14, 2000

[54] SYSTEM AND METHOD FOR APPLYING FINGERNAIL ART

[75] Inventor: Mark Mombourquette, Newport, Ky.

[73] Assignee: Belquette Ltd., Newport, Ky.

[21] Appl. No.: 09/231,438

[22] Filed: Jan. 14, 1999

[51] Int. Cl.[7] ..... A45D 24/00; A45D 29/00; A45D 29/18

[52] U.S. Cl. ..... 132/200; 132/73; 132/73.5; 132/75.3

[58] Field of Search ..... 132/200, 201, 132/73, 73.5, 73.6, 75.3; 118/31.5, 669, 676, 13, 30

[56] References Cited

U.S. PATENT DOCUMENTS

| | | | |
|---|---|---|---|
| 4,436,684 | 3/1984 | White | 264/138 |
| 4,469,022 | 9/1984 | Meador | 101/38 |
| 4,548,825 | 10/1985 | Voss et al. | 426/383 |
| 4,575,805 | 3/1986 | Moermann et al. | 364/474 |
| 4,611,246 | 9/1986 | Nihei | 358/256 |
| 4,611,288 | 9/1986 | Duret et al. | 364/474 |
| 4,843,958 | 7/1989 | Egosi | 101/2 |
| 4,910,661 | 3/1990 | Barth et al. | 364/167.01 |
| 4,949,283 | 8/1990 | Yamauchi et al. | 364/519 |
| 4,981,487 | 1/1991 | da Costa | 8/507 |
| 5,079,639 | 1/1992 | Mochinaga | 358/473 |
| 5,309,365 | 5/1994 | Sullivan et al. | 364/474.03 |
| 5,505,775 | 4/1996 | Kitos | 118/14 |

*Primary Examiner*—John J. Wilson
*Assistant Examiner*—Robyn K. Doan
*Attorney, Agent, or Firm*—Wood, Herron & Evans, L.L.P.

[57] ABSTRACT

A system for applying artwork to fingernails has a computer controller, a hand mold to securely hold the user's fingernails, a device for determining the size and location of the fingernails, and an applicator for applying the artwork. A method for applying artwork to fingernails provides color and/or design choices selected from a computer media catalogue of colors and designs. A user views these choices on a video monitor, which also displays messages to guide the user through the application process. Prior to application of the artwork, the fingernails are coated with a light reactive base coat. The user's hands are inserted into a hand mold in which a height sensor and height gauge aid in positioning the fingernails at a preferred height position. The hand mold is retracted into a main system module in which an optical sensor detects the light reactive base coating for determining the size, peripheral shape, and location of the fingernails. A color applicator in the main system module applies the user selected artwork directly to the user's fingernails.

38 Claims, 3 Drawing Sheets

SYSTEM AND METHOD FOR APPLYING FINGERNAIL ART

FIELD OF THE INVENTION

This invention relates generally to fingernail art, and more particularly to a computer assisted system and method for applying fingernail at

BACKGROUND OF THE INVENTION

Applying nail color or designs to fingernails to obtain a desired art effect has long been a manual task involving considerable time and skill when applied by either the recipient, or a nail salon technician. Currently, self-application is the most common practice of applying color or artwork to nails. With practice, single color self-application, or simple multiple color self-application can result in satisfactory results. However, for detailed and/or high quality artwork, a skilled nail salon technician is often required. Nail salons often employ local art students for their talents when a clientele demands a high degree of nail design artistry. Frequently, however, nail salons either are unable to or choose not to retain on their staff personnel skilled in fingernail art application.

Fingernail and thumbnail color and design application becomes increasingly labor and time intensive as the artwork becomes more intricate. A base coat is usually applied before the nail technician applies any color or artwork. The technician and the client must wait for this base coat to dry before proceeding with further decoration. Once the base coat dries, a commonly used laquer based nail polish can be applied by a brush set into the cap of the nail polish bottle. Of course, if the client desires more than a simple single color, the technician may use many different bottles and brushes in order to create a finished product to suit the client's tastes. The most intricate designs require that an artist use an airbrush. Such a finished product would be difficult if not impossible to achieve for a person of average artistic skills, especially when considering that the quality of the design would vary dramatically when such a person would attempt to apply the design at an awkward angle.

There are several further disadvantages to the manual application of nail colors and designs. For example, application by hand is time intensive. Prolonged exposure to many open bottles of lacquer based nail polishes in a salon environment may cause health related problems to the nail technician, such as respiratory and/or ocular irritation. Furthermore, if a person desires artistic designs on their nails, such application is limited by that person's or a nail salon technician's artistic abilities.

It is, therefore, an objective of the present invention to provide an automated system and method to apply artwork comprised of colors and/or designs directly to the fingernails of a user's hand.

It is a further objective of the present invention to provide computer media catalogues of plural colors and designs so a customer can select artwork which is then applied through the automated system and method.

It is a further objective of the present invention to provide a color applicator that is computer controlled to provide selected artwork substantially simultaneously to a plurality of the user's fingernails.

It is a further objective of the present invention to provide a fingermold cooperable with a color applicator to hold the fingernails of the user in a preferred art coating position, the applicator not being operable unless the mold is in the preferred art coating position.

It is a further objective of the present invention to provide a video monitor to allow the user to view the artwork as it is being applied to the fingernails.

SUMMARY OF THE INVENTION

The present invention relates to a system and method for automatically coating fingernails with artwork comprised of one or more colors and/or designs selected from a catalogue of colors and designs. The user accesses a catalogue stored in computer media form to choose the desired colors and/or designs. These colors and/or designs are viewed on a video monitor, which also displays messages to guide the user through the selection of the desired finished art effect and to execute commands to complete that art. The user may preview the final art effect by executing a command to have the art first displayed on the video monitor.

Prior to application of the design, the user coats the fingernail, but no surrounding skin, with a light sensitive base coat. This coating contains an agent which reacts to a light source once the fingernail is inserted into an applicator, so that a sensor may determine size, peripheral shape and location parameters of the fingernail for accurate art application. After the user applies the base coat, a removable coat of a protective coating is applied to both the fingernail and the skin surrounding the fingernail, which not only facilitates bonding of the art media to the fingernail, but also allows the user to easily wash off any color overspray onto the skin.

The user then inserts his or her hand into a hand mold, which positions the fingernails of the user at a preferred coating height position. This position is achieved with the aid of a height sensor that senses when the fingernails are located in the preferred art coating position. A height gauge signals to the user when the fingernails are at the correct height. Once the fingernails are in this position a hold down gate is lowered to secure the user's hand in place relative to the hand mold.

The mold is positioned in operational registration with a color applicator in a main system module. When in registration with the color applicator, an optical sensor, receptive to light reflected from the light sensitive base coat, gathers information about the fingernails' size, peripheral shape, and location in space. This information is stored in the system's computer, along with the selected art information. The user then inputs commands to the computer, which controls a color applicator that directly applies the desired art effect to the user's fingernails. The system also provides a video interface which allows the user to watch the progress of the art application on the monitor as the application takes place.

DETAILED DESCRIPTION OF THE DRAWINGS

Figure 1:
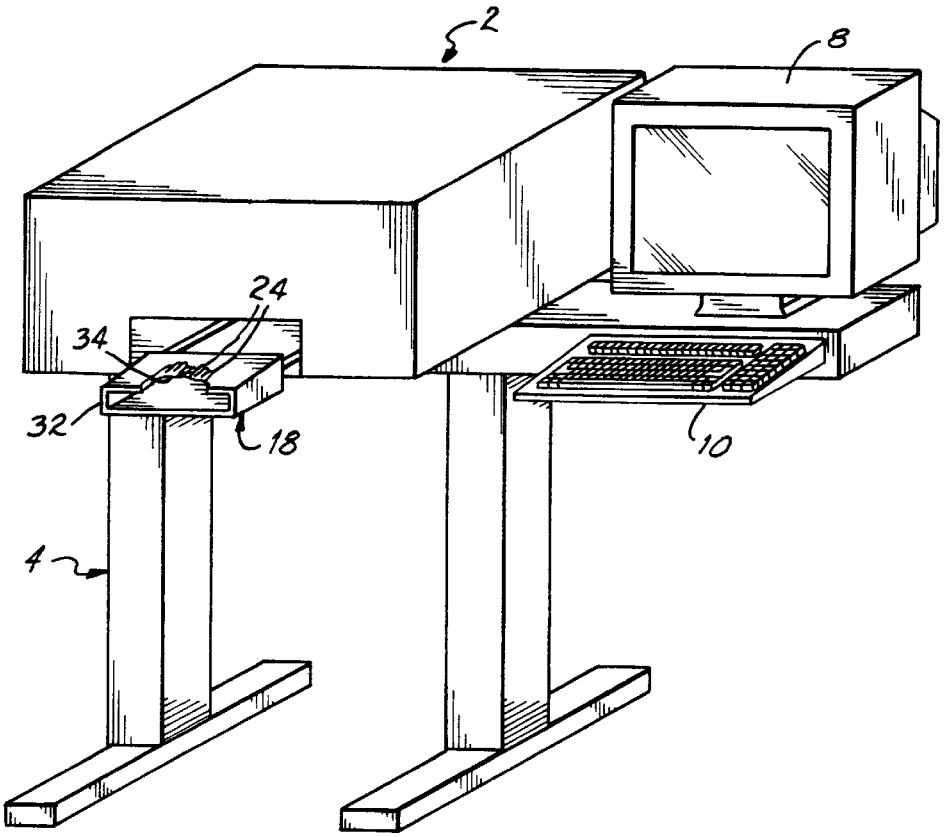
FIG. 1 is a perspective view of the automated nail art system.
Figure 2:
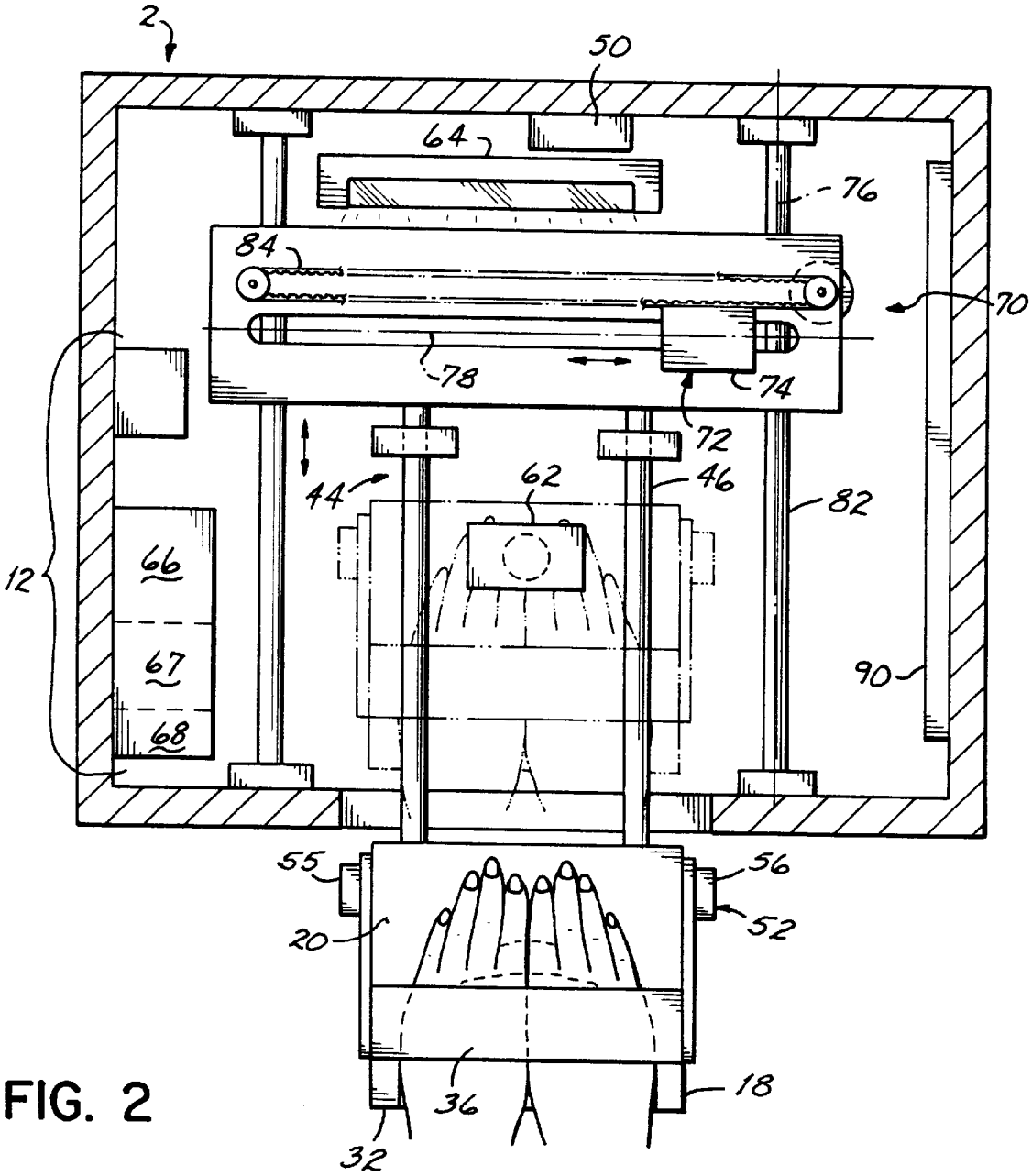
FIG. 2 is a top elevation view of the main system module and hand mold of FIG. 1.

Referring to FIGS. 1 and 2, the fingernail artwork application system of the present invention comprises a main system module 2 supported by a base stand 4, a video monitor 8, and a keyboard 10. The main system module 2 houses computer 12 and a color applicator 70 for applying the artwork to the fingernails of the user. In the preferred embodiment, the color applicator 70 can be any commercially available ink jet printer, such as Hewlett Packard Desk Jet 820, a Hewlett Packard Desk Jet 870 CSE, or an Epson 850. A hand mold 18 is provided, which is connected to the main system module 2. As described in more detail below, the hand mold 18 enables a user to position one or more fingernails into a preferred height position, and next to a preferred art coating position when the hand mold 18 is inserted into operational relation with the color applicator 70.

As shown diagrammatically in FIG. 2, the computer 12 of the main system module 2 comprises a data collection and storage module 66, a data computation module 67, a video interface 68, and a system power supply 69. The data collection and storage module 66 has access to a computer media catalogue (not shown), which holds a plurality of color and design variances so that a desired art effect can be created for the user. As will be readily appreciated by those skilled in the art, such computer media catalogues can be in many forms, including, without limitation, data on computer diskettes, CD-roms, computer software programs and/or retrieved from the Internet.

The video monitor 8 is electrically connected to the video interface of the computer 12 to permit the user to view color and design schemes for selection of a desired art effect from the information in the computer media catalogue and or from the information stored in the data collection and storage module 66. The video monitor 8 also displays program instructions guiding the user through the art selection and application process. The keyboard 10, which is electrically connected to the computer 12, allows the user to interact with the instructions displayed on the video monitor 8 and to enter his or her selections and commands. Upon selection of the desired colors and artwork, the user may preview the selections prior to application of the artwork to the user's fingernails by displaying the selection on the video monitor, or by printing the selection on a disposable substrate, such as paper (not shown).

The hand mold 18 enables the user to position the fingernails first into a preferred height position, and second to a preferred art coating position when the hand mold 18 is inserted in operational relation with the color applicator 70 housed within the main system module 2. In the preferred embodiment, thumb contours 26 in the hand mold 18 are recessed into finger contours 24, which are, in turn, recessed into the upper surface of the hand mold 18. The hand mold 18 further includes a hand cut-out pattern 34, which allows the user to position the fingernails in the hand mold 18 in a relatively comfortable fashion.

Upon insertion of the fingernails into the hand mold 18, the fingernails operatively contact a height sensor 52, which senses the height of the fingernails relative to the height of the color applicator 70 when the fingernails are placed in operational relation therewith. In the preferred embodiment, the height sensor 52 includes a projector 55 that projects a beam of infrared light from one side of the hand mold 18 to a receiver 56 on the opposite side of the hand mold 18. A signal proportional to the interference of the fingernails with the beam of infrared light is generated and transferred to a height gauge 58, which provides a visual indication to the user of the position of the fingernails in comparison to the preferred height position. This arrangement allows the user to change fingernail placement until the preferred art application height is achieved. In the preferred embodiment, the height gauge 58 is an LED display. When the user has positioned the fingernails at the preferred height, a hold down gate 36 pivotally mounted to the hand mold 18 is lowered over the hands to secure the fingernails in the proper position within the hand mold 18. It will be readily appreciated that other height sensors and height gauges may be used without departing from the spirit or scope of the present invention.

With the fingernails secured at the proper height, the user moves the mold 18 into operational relationship with the color applicator 70. Specifically, the hand mold 18 moves along a positioner 44, which is comprised of a slide assembly 46 having a detent assembly 48 that dead stops the hand mold 18 at the end of its forward travel. When in this position, an optical sensor 62, which is electrically connected to the computer 12, determines the size, peripheral shape and location in space of the fingernail. In the preferred embodiment, the optical sensor 62 includes a Charge Coupled Display camera ("CCD"). The optical sensor 62 detects the physical parameters regarding the size and shape of the fingernails when a bluing agent applied as a base coat on the fingernails reacts to a light source 64 by glowing brightly. In the preferred embodiment, the light source 64 is a blacklight. However, as will be readily appreciated, any other light source that reacts with a base material may be used. The physical parameters data detected by the optical sensor 62 is relayed to the data computation module 67 of the computer 12, and may be stored in the data collection and storage module 66. Once fingernail physical parameter data and the art information is stored in the data collection and storage module 66, the user may enter instructions through the keyboard 10, or other user interface, to command the color applicator 70 to apply the color.

The color applicator 70 includes a logic and control system 90 (shown diagrammatically), which is electrically connected to the computer 12 and which controls the operation of the color applicator. The color applicator 70 uses a piezo electric drop on demand type print head 72 having a plurality of orifices through which the print head 72 expels a plurality of colors. Alternatively, the print head 72 may comprise a thermal ink jet drop on demand media application. In a still further embodiment, the print head 72 may comprise a wax jet drop on demand system. In the preferred embodiment, the color media is water based ink, however, wax, solvent based inks, pigments, dyes, and laquer can also be successfully used. One such water based ink is available from Independent Ink, Inc., in Gardenia, Claif. The color media is stored in a cartridge 74 until needed for application. The cartridge 74 may be a four color CMYK cartridge, a three color RGB cartridge, or other similar color cartridge that provides continuous tones of color application.

The print head 72 of the color applicator 70 travels in both an X-axis direction generally perpendicular to the user's normal front facing position, and Y-axis direction generally parallel to the user's normal front facing position, which travel is controlled by the logic and control system 90. The X-axis motion 76 is guided along linear rails 82 which carry the print head 70 in the generally perpendicular direction relative to the user's normal front facing position. In the preferred embodiment, the X-axis motion 76 is driven with a stepper motor, timing pulleys, and timing belts connected to the color applicator 70, and a linear guide with power transmission (not shown). The Y-axis motion 78 of the color applicator 70 is guided on a track 84 in a generally parallel direction relative to the user's normal front facing position. The color applicator logic and control system 90, which includes a power supply, drive system and motor control, proximity sensor logic and a microprocessor interface, as are well known in drop on demand ink applicator systems, provides continual feedback to the data computation module 67 of the X and Y position of the print head 72, which, in turn, translates the information to the video interface 68 for display on the video monitor 8 for viewing by the user.

Figure 4:
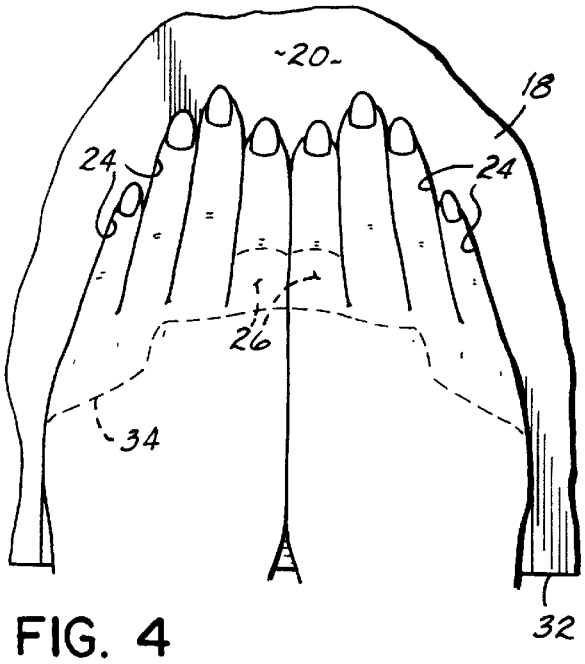
FIG. 4 is a top elevation view of the hand mold of FIG. 1 with a user's fingernails inserted.
Figure 3:
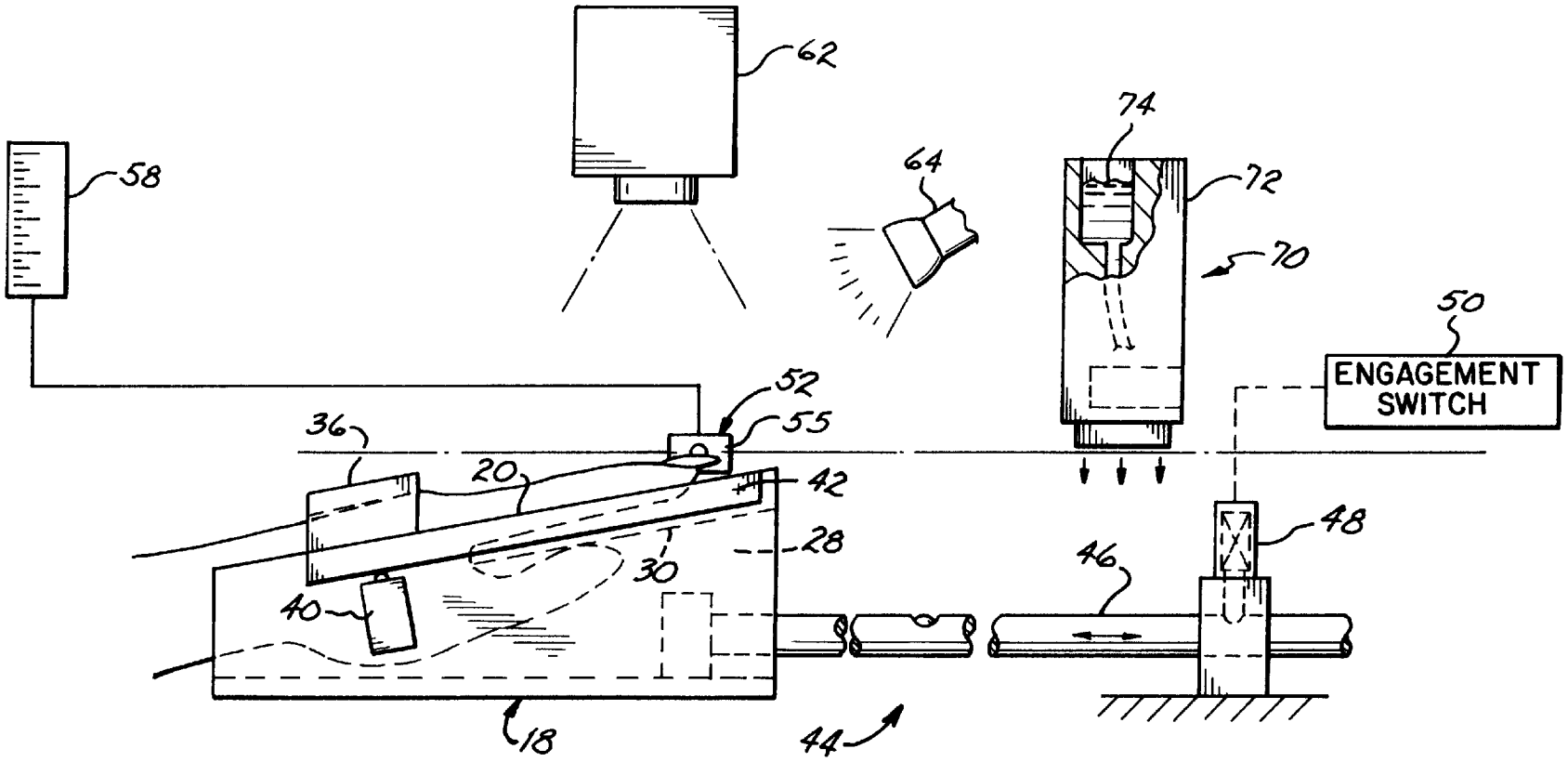
FIG. 3 is a partial diagrammatic side view of a user's fingernails in operational relation with the hand mold, height sensor, height gauge, optical sensor, color applicator, and hand mold slide assembly of FIG. 1.

Referring to FIGS. 3 and 4, the fingernails are inserted into the hand mold 18 with the fingers, in this view, resting in finger contours 24 formed in the upper surface 20 of hand mold 18. The other of the fingers and/or thumbs not set into the finger contours 24 are held in a lined cavity 28 beneath the mold surface 20. In the preferred embodiment, the contoured mold surface 20 is angled upwardly from a plane horizontal relative to the slide assembly 46 so that the height of the fingernails will rise to the level of the receiver 56 of the height sensor 52 as the fingers of the user are inserted into the finger contours 24 of hand mold 18. The user determines when the preferred fingernail height is achieved by observing the height gauge 58, which visually indicates the position of the user's fingernails relative to the preferred height position. Once the preferred fingernail height is achieved, the hold down gate 36 is lowered to secure the fingernail at the preferred fingernail height. The hold down gate 36, which is comprised of a gate latch 38 pivotally connected to hand mold 18, may include a safety gate switch 40 electrically connected to the system computer 12. The gate switch 40 is in a closed position when the gate latch 38 is lowered, and is in an open position when the gate latch 38 is raised. When the gate switch 40 is open, the system computer 12 will not permit the color applicator 70 to operate, thereby preventing improper application of the artwork or injury to the user.

After the gate latch 38 is lowered, the user places the fingernails into registration with the optical sensor 62 and the color applicator 70 by moving the hand mold 18 on the slide assembly 46 into the main system module 2 until the detent assembly 48 dead stops the hand mold 18 in the preferred art coating position. The detent assembly 48 includes an engagement switch 50 that is electrically connected to the system computer 12. When the hand mold 18 is in the inserted, preferred art coating position, the engagement switch 50 is closed, whereas engagement switch 50 is open when the hand mold 18 is not in the preferred art coating position. As with the gate switch 40, when the engagement switch 50 is open, the system computer 12 will not permit the color applicator 70 to operate, thereby preventing improper application of the artwork or injury to the user.

Referring to FIGS. 4 and 6, hand mold 18 further includes thumb contours 26 recessed in the two middle finger contours 24. The hand cut-out pattern 34, which is formed in the hand mold 18, allows the fingers or thumbs to gain easy access to the contours 24, 26 so that the fingernails may more easily achieve the preferred fingernail height. In the preferred embodiment, the hold down gate 36 pivots on axis 42, and the cavity 28 below the mold surface 20 is lined with a comfortable material 30, such as foam padding, to hold the fingers and portion of hand not needed on the mold surface 20 for color application.

In operation, a user, who is seated in front of the module 2, is led through a series of steps by the system computer 12 for the automated fingernail art process. The steps of the art application process are displayed on the video monitor 8, with the user responding to each of the steps using the keyboard 10, or other user interface, such as a computer mouse. The monitor 8 also displays color, design and fingernail images to allow the user to visually select the desired art effect, and to view the application progress once the application has begun. These images are displayed from a catalogue of colors and designs, which may be provided from a variety of computer data storage media, such as computer diskettes, CD-roms, software programs and/or Internet images.

The user selects one or more of a plurality colors and designs in a combination that will result in the desired art effect on the user's fingernails. These color and design choices are stored in the data collection and storage module 66 until the user's fingernails are in a preferred art coating position, i.e., in registration with the color applicator 70, at which time the art effect can be applied, as shown in FIG. 3. To preview the artwork prior to application to the user's fingernails, the user may display the selected artwork on the video monitor 8, or print the selected artwork on a disposable substrate, such as paper (not shown).

Prior to placing the hands in the hand mold 18, the user's fingernails only, and not the skin surrounding the fingernails, are coated with a base coat. This base coat preferably contains a bluing agent which is light sensitive. The light sensitive element in the base coat allows the optical sensor 62 to detect the configuration and location in space of the fingernails once they are placed in the preferred art coating position as discussed below. After the base coat is applied, a water receptive coat is preferably applied to the fingernails and to the skin surrounding the fingernails. The water receptive coat serves two purposes. First, it allows the color media to bond to the base coat on the fingernail. Second, since the base coat is not applied to the skin surrounding the fingernail, and since the water receptive coat is applied to the skin surrounding the fingernail, any overspray of the color media onto the skin can be easily washed off when the water receptive coat on the skin is washed off. The water receptive coat may be applied prior to placement of the fingers in hand mold 18, or it may be automatically applied by the color applicator 70 after the hand mold 18 is moved into the preferred art coating position.

Following application of the water receptive coat, the fingernail art coating is applied by the color applicator 70. A final top coat is then applied over the fingernail art to make the fingernails and the desired art effect durable and waterproof. After the top coat has dried, the user may simply wash off any water receptive coat overspray which fell onto the skin.

Figure 5:
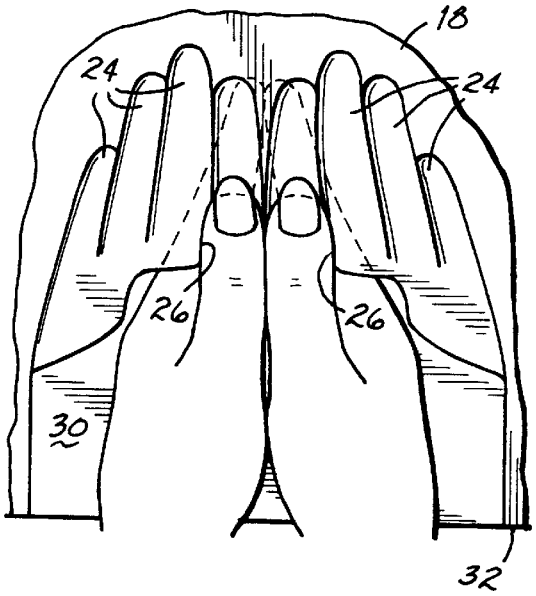
FIG. 5 is a top elevation view of the hand mold of FIG. 1 with a user's thumbnails inserted.

The fingernail art system of this invention uses the hand mold 18 to place the fingernails in the preferred art coating position. As shown in FIGS. 3–5, the user's hands are placed in the hand mold 18, which includes the finger and thumb contours 24, 26 formed in the surface 20 to accommodate any size fingers or thumbs. As shown in FIGS. 4 and 5, at least one thumb contour 26 is embedded into a finger contour 24 for each of a user's right and left hands. The hand mold 18 is positionable external to the color application area to allow the user's hands and fingers to be positioned correctly and in view. If at least one of fingers or thumbs are placed in the mold 18, the other of fingers or thumbs that are not to have the selected art applied, may be positioned below the mold surface in a lined cavity 28 designed to comfortably hold that portion of the user's hand not needed for positioning the chosen fingernails. To aid in keeping the hands comfortable, the mold 18 has a cut out pattern 34 at the anterior edge 32 to allow the user's hands to be positioned in a relatively comfortable position during the fingernail height adjustment and art application step of the method.

The user slides the fingers and/or thumbs to which the art is to be applied in the upwardly sloped contours 24,26 until the preferred art coating height is achieved. This is achieved by viewing the height gauge 58, which displays the height of the fingernails relative to the preferred height position.

Once the fingernails are in the preferred application height, the hold down gate 36 is lowered to secure the user's hands and fingernails at this height, thereby preventing movement of the fingernails during the application of the desired art effect. The hold down gate 36 cooperates with a latch 38 which locks down the gate 36. Once hold down gate 36 is lowered, gate switch 40 is closed, which indicates to the system computer 12 that fingernails are positioned within hand mold 18 for application of the selected art effect by the color applicator 70.

Hand mold 18 is then moved forward on slide assembly 46 until detent assembly 48 dead stops, thereby placing the user's fingernails into the preferred art coating position in operational relation with the color applicator 70. Upon movement of hand mold 18 into the preferred art coating position, engagement switch 50 of the detent assembly is closed, indicating to the system computer 12 that hand mold 18 is positioned for application of the art effect to the user's fingernails.

Once the hand mold 18 is moved into the preferred art coating position, as shown in FIG. 2, optical sensor 62 detects the configuration and location in space of the fingernails, including the size and peripheral shape of the fingernail. A light 64 is radiated on the user's fingernails and sensor 62 detects the contrast between the bright fingernail, which has the base coat applied thereto, and the dark surrounding skin, which had received no base coat treatment. The white balance, contrast and brightness settings of sensor 62 are calibrated such that the bright fingernail areas register and the dark skin areas do not register. The bright pixel intensities detected by sensor 62 are relayed to the data computation module 67 for determination of the fingernail size and shape, which parameters are stored in the data collection and storage module 66. Using these parameters, software, which is readily available and understood, configures the desired art effect for each fingernail chosen.

When the user is ready to proceed with the desired art application, the user inputs commands to the system computer 12 to commence and the color applicator 70 performs the required movements in the X and Y-axes 76, 78 to apply the colors and designs selected to create the desired art effect. The data computation module 67 relays information to the color applicator logic and control system 90. The logic and control system 90, which includes X and Y-axis 80 drivers and proximity sensor logic, translates the commands from the data computation module 67 into appropriate color, design and coordinate data.

After application of the selected artwork, the user slides hand mold 18 out of the preferred art coating position, raises the hold down gate 36, and removes his or her hand from hand mold 18. This process is then repeated for each artwork effect desired.

By virtue of the foregoing, there is provided a system and method for automatically applying a desired art effect to fingernails. Further, the system and method of the present invention provides for the automatic application of art comprised of colors and/or designs directly to fingernails of a user's hand. It also provides for a computer media catalogue of plural colors and designs so a user can select art which is then applied through this automated method and system. The system and method of the present invention further provides for a color applicator that is computer controlled to provide selected art substantially simultaneously on plural fingers directly to the fingernails of a user's hands. The invention also provides for a mold cooperable with the color applicator to hold fingernails in a preferred art costing position, the applicator not being operable unless the mold is in the preferred art coating position. Finally, the system and method of the present invention provides for a video monitor to permit the user to view the art as it is being applied to the user's fingernails.

While the present invention has been illustrated by a description of a preferred embodiment, which has been described in considerable detail, it is not the intention of the applicant to restrict or in any way limit the scope of the appended claims to such detail. Additional advantages and modifications will readily appear to those skilled in the art. Thus, the invention in its broadest aspects is not limited to the specific details, representative apparatus and method, and illustrative examples shown and described. Accordingly, departures may be made from the details without departing from the spirit of scope of applicant's general inventive concept.

What is claimed is:

1. A method of coating a fingernail on a hand with art comprised of at least one of a color and a design, said method comprising the steps of:

inserting said fingernail into a mold for aid in locating said fingernail and said hand at a preferred art coating position;

providing a color applicator in operational relation with said hand mold and, thereby, with said fingernail, when said mold is in said preferred art coating position; and applying art to said fingernail by controlling operation of said color applicator by a computer processor so that said art is applied directly to said fingernail on said hand by said color applicator.

2. A method of coating fingernails as claimed in claim 1, said method further comprising the steps of:

sensing at least one of the size, peripheral shape and location of said fingernail; and processing the information sensed about the fingernail's size, peripheral shape and location for application of said art through use of said computer processor.

3. A method of coating fingernails as described in claim 2 wherein said sensing step includes the steps of:

coating said fingernail with a base coat of light sensitive coating, said base coat being provided on said fingernail only and on no surrounding skin; and providing an optical sensor to sense said light sensitive coating for sensing at least one of the size, peripheral shape and location of said fingernail when said fingernail is in said preferred art coating position.

4. A method of coating fingernails as claimed in claim 3, said method further comprising the step of:

coating said skin surrounding said fingernail with a removable coat of a protective coating.

5. A method of coating fingernails as claimed in claim 4, said method further comprising the step of:

washing said removable coat from the surrounding skin after art has been applied to said fingernail by said color applicator.

6. A method of coating fingernails as claimed in claim 3, said method further comprising the step of:

exposing said light sensitive coating to a blacklight.

7. A method of coating fingernails as claimed in claim 1, said method further comprising the step of:

viewing on a video monitor the application of said art to said fingernail as said art is applied to said fingernail.

8. A method of coating fingernails as claimed in claim 1, said method further comprising the step of:

simultaneously applying said art to a plurality of fingernails.

9. A method of coating fingernails as claimed in claim 1, said method further comprising the steps of:

first locating said mold at a preliminary position where said fingernail and hand are established in a preferred orientation relative to said color applicator; and thereafter moving said mold from said preliminary position to said preferred art coating position while retaining said fingernail and hand in said preferred orientation.

10. A method of coating fingernails as claimed in claim 9 wherein said step of locating said fingernail and hand at a preliminary position where said fingernail and hand are established in a preferred orientation relative to said color applicator includes sensing with a height sensor the height of said fingernail in said mold relative to a preferred height position.

11. A method of coating fingernails as claimed in claim 1, said method further comprising the steps of:

providing a catalogue of at least one of plural colors and plural designs in computer media form, said computer media being operatively connected with a video monitor;

viewing said catalogue on said monitor in order to determine which of said colors and designs is desired; and selecting from said catalogue that art desired for application to said fingernail.

12. A method of coating fingernails on a hand with art comprised of at least one of a color and a design as selected from a catalogue of at least one of plural colors and plural designs, said method comprising the steps of:

providing said catalogue in computer media form, said computer media being connected with a video monitor;

viewing said catalogue on said monitor in order to determine which of said colors and designs is desired;

selecting from said catalogue that art desired for application to a fingernail;

inserting said fingernail into a mold for aid in locating said fingernail and said hand at a preferred art coating position;

sensing with a height sensor the height of said fingernail in said mold relative to said preferred art coating position;

providing a color applicator in operational relation with said fingernail when said fingernail and said hand are in said preferred art coating position; and controlling operation of said color applicator by said computer processor so that said selected art is applied directly to said fingernail on said hand by said color applicator.

13. A method of coating fingernails as claimed in claim 12, said method further comprising the step of:

observing a height gage connected to said height sensor to allow said fingernail to be adjusted with said mold to a preferred fingernail height position.

14. A method of coating fingernails as claimed in claim 12, said method further comprising the steps of:

first locating said mold at a loading position where said fingernail is inserted in said mold; and thereafter moving said mold with said fingernail inserted therein to said preferred art coating position.

15. A system for coating a fingernail on a hand with art comprised of at least one of a color and a design, said system comprising:

a hand mold for aid in locating at least one fingernail on at least one hand at a preferred art coating position;

a color applicator in operational relation with said hand mold and, thereby, with said fingernail, for coating said fingernail when said hand mold is in said preferred art coating position; and an applicator controller operatively connected with said applicator, said controller being adapted to control said color applicator in the direct application of said art to said fingernail on said hand.

16. A system for coating a fingernail as claimed in claim 15 wherein said hand mold is adapted to locate at least one fingernail from each of the hands of a user for simultaneous application of said artwork by said color applicator to said at least one fingernail on each of said hands.

17. A system for coating a fingernail as claimed in claim 15, said system further comprising:

a height sensor connected to said hand mold for sensing the height of said fingernail in said hand mold relative to said preferred art coating position.

18. A system for coating a fingernail as claimed in claim 17, said system further comprising:

a height gauge connected to said height sensor for allowing said fingernail to be adjusted within said hand mold to a preferred fingernail height position.

19. A system for coating a fingernail as described in claim 15 wherein said hand mold includes an angled hand support surface to accommodate fingers of different thicknesses, said support surface allowing the height of said fingers to be adjusted by sliding said fingers up and down said angled support surface.

20. A system for coating a fingernail as claimed in claim 15, said system further comprising:

a catalogue in computer media form, said catalogue having at least one of plural colors and plural designs;

a video monitor for viewing said catalogue in order to determine which of said colors and designs is desired; and a selector for selecting from said catalogue the art desired for application to said fingernail.

21. A system for coating a fingernail as claimed in claim 15, said system further comprising:

a sensor for sensing at least one of the size, peripheral shape and location of said fingernail when said fingernail is in said preferred art coating position.

22. A system for coating a fingernail as claimed in claim 21 wherein said sensor comprises an optical sensor sensitive to a light sensitive coating applied to said fingernail.

23. A system for coating a fingernail as claimed in claim 15 wherein said hand mold is operable to first locate said fingernail and said hand at a preliminary position where said fingernail and said hand are established in a preferred orientation relative to said color applicator, and then to relocate said fingernail and said hand from said preliminary position to said preferred art coating position while retaining said fingernail and said hand at said preferred orientation.

24. A system for coating fingernails on at least one hand with art comprised of at least one of a color and a design as selected from a catalogue of at least one of plural colors and plural designs, said system comprised of:

a catalogue in computer media form, said catalogue having at least one of plural colors and plural designs;

a monitor for viewing said catalogue in order to determine which of said colors and designs is desired;

a selector for selecting from said catalogue that art desired for application to a fingernail;

a hand mold for aid in locating said fingernail and said hand at a preferred art coating position;

a height sensor for sensing the height of said fingernail in said hand mold relative to said preferred art coating position;

a fingernail coater for coating said fingernail with a base coat of a light sensitive coating, said base coat being provided on said fingernail only and on no surrounding skin;

an optical sensor sensitive to said light sensitive coating, said optical sensor being adapted to sense at least one of said fingernail's size, peripheral shape and location when said fingernail and said hand are in said preferred art coating position;

a color applicator in operational relation with said fingernail when said fingernail and said hand are in said preferred art coating position;

a processor for processing the information gathered by said optical sensor about at least one of the size, peripheral shape and location of said fingernail, and the art information selected from said catalogue; and an applicator controller connected with said computer processor, said controller and said processor cooperating to effect direct application of the selected art directly onto said fingernail on said hand by said color applicator.

25. A system for coating fingernails as claimed in claim 24, said system further comprising:

a skin coater for coating said skin surrounding said fingernail with a removable protective coating.

26. A system for coating fingernails as claimed in claim 24, said system further comprising:

a light source to which the light sensitive coating is exposed, said light source being adapted to cooperate with said light sensitive coating so that at least one of said fingernail's size, peripheral shape and location can be sensed by said sensor.

27. A system for coating fingernails as claimed in claim 24, said system further comprising:

a height gauge connected to said height sensor for allowing said fingernail to be adjusted with said mold to a preferred fingernail height position.

28. A system for coating fingernails as described in claim 24 wherein said hand mold includes an angled hand support surface to accommodate fingers of different thicknesses, said support surface allowing the height of said fingers to be adjusted by sliding said fingers up and down said angled support surface.

29. A system for coating fingernails as claimed in claim 24, said system further comprising:

a hold down gate pivotally connected to said hand mold, said hold down gate adapted to hold said hand in a fixed position within said hand mold.

30. A mold system for positioning at least one of a fingernail and a thumbnail in a preferred art position relative to a color applicator in order to receive at least one of a color and a design, said hand mold system comprising:

a mold including at least one of a finger or thumb contour, said contour being adapted to aid in locating at least one of a user's fingernail's in said preferred art coating position;

a hand cut-out pattern formed in said mold to allow the user to position the user's hand in a relatively comfortable position when placing said at least one of said fingernail and said thumbnail in said hand mold system;

a hold down gate connected to said mold, said hold down gate being operable to hold down the user's hand, and thereby said at least one of said fingernail and said thumbnail, in said preferred art coating position, said hold down gate being movable between a hold down position and a release position; and a positioning assembly connected to said mold to move said mold into and out of operational relation with said color applicator.

31. A mold system as described in claim 30, said mold having both thumb and finger contours, said thumb contour being molded into at least one finger contour.

32. A mold system as described in claim 30, said mold system further comprising:

an angled hand support surface connected with said mold, said support surface allowing the user's fingernails and thumbnails to be positioned in said preferred art coating position.

33. A mold system as described in claim 32, said mold system further comprising:

a gate latch adapted to connect said hold down gate and said mold in operational assembly.

34. A mold system as described in claim 33, said mold system further comprising:

a mold switch adapted to cooperate with said gate latch and said coloring applicator, said mold switch deactivating said color applicator when said hold down gate is not in said hold down position.

35. A mold system as described in claim 30, said mold system further comprising:

a color switch adapted to cooperate with said mold, said color switch deactivating said color applicator when said mold is not in said preferred art coating position.

36. A color application system for applying art in the form of at least one of a color and a design to at least one of a fingernail and a thumbnail placed in a hand mold, said applicator system comprising:

a sensor for determining at least one of the size, peripheral shape and location of that fingernail to receive said art;

a media expulsion device connected with said sensor for applying said art to a user's fingernails;

an X axis driver connected in operational relation with said expulsion device to move said expulsion device in a direction generally normal to a user's front facing position while said art is being applied to said fingernail; and a Y axis driver connected in operational relation with said expulsion device to move said expulsion device in a direction generally side to side relative to the user's front facing position while said art is being applied to said fingernail.

37. A color applicator system as described in claim 36, said applicator system further comprising:

a mold for receiving that fingernail on which said art is to be provided.

38. A color applicator system as described in claim 37, said applicator system further comprising:

a light source in operational combination with said sensor.

* * * * *